US008574374B2

(12) United States Patent
Hueffer et al.

(10) Patent No.: US 8,574,374 B2
(45) Date of Patent: Nov. 5, 2013

(54) FORMULATIONS, THEIR USE AS OR FOR PRODUCING DISHWASHING COMPOSITIONS AND THEIR PREPARATION

(71) Applicants: Stephan Hueffer, Ludwigshafen (DE); Alejandra Garcia Marcos, Ludwigshafen (DE); Markus Hartmann, Neustadt (DE); Heike Weber, Mannheim (DE)

(72) Inventors: Stephan Hueffer, Ludwigshafen (DE); Alejandra Garcia Marcos, Ludwigshafen (DE); Markus Hartmann, Neustadt (DE); Heike Weber, Mannheim (DE)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 13/654,814

(22) Filed: Oct. 18, 2012

(65) Prior Publication Data

US 2013/0102515 A1 Apr. 25, 2013

Related U.S. Application Data

(60) Provisional application No. 61/550,455, filed on Oct. 24, 2011.

(30) Foreign Application Priority Data

Oct. 19, 2011 (EP) ..... 11185824

(51) Int. Cl.

| | |
|---|---|
| ***B08B 3/04*** | (2006.01) |
| ***C11D 3/12*** | (2006.01) |
| ***C11D 3/33*** | (2006.01) |
| ***C11D 3/395*** | (2006.01) |

(52) U.S. Cl.

USPC ..... 134/25.2; 134/25.3; 134/39; 134/42; 510/223; 510/229; 510/499

(58) Field of Classification Search

USPC ..... 510/223, 229, 499; 134/25.2, 25.3, 39, 134/42

See application file for complete search history.

(56) References Cited

U.S. PATENT DOCUMENTS

| | | | | |
|---|---|---|---|---|
| 3,841,982 | A | 10/1974 | Yee | |
| 5,714,447 | A * | 2/1998 | Jones et al. | 510/131 |
| 5,981,456 | A | 11/1999 | Tartakovsky et al. | |
| 6,239,091 | B1 | 5/2001 | Tartakovsky et al. | |
| 6,281,180 | B1 | 8/2001 | Tartakovsky et al. | |

FOREIGN PATENT DOCUMENTS

| | | | | |
|---|---|---|---|---|
| DE | 198 19 187 | A1 | 11/1999 | |
| EP | 0 383 482 | A2 | 8/1990 | |
| EP | 0 561 452 | A1 | 9/1993 | |
| EP | 0 851 023 | A2 | 7/1998 | |
| EP | 1 721 962 | A1 | 11/2006 | |
| EP | 2 118 254 | | 11/2009 | |
| WO | WO 99/05248 | | 2/1999 | |
| WO | WO 02/064719 | A1 | 8/2002 | |
| WO | WO 03/104370 | A1 | 12/2003 | |
| WO | WO 2008/095562 | A1 | 8/2008 | |
| WO | WO 2009/024780 | | 2/2009 | |
| WO | WO 2010/020765 | A1 | 2/2010 | |
| WO | WO 2010/116139 | * | 10/2010 | C11D 3/39 |

OTHER PUBLICATIONS

European Search Report issued Apr. 2, 2012, in Patent Application No. EP 11 18 5824.

International Search Report issued Jan. 11, 2013 in PCT/EP2012/069816 filed Oct. 8, 2012.

U.S. Appl. No. 13/654,807, filed Oct. 18, 2012, Hueffer, et al.

U.S. Appl. No. 13/655,012, filed Oct. 18, 2012, Hueffer, et al.

* cited by examiner

*Primary Examiner* — Brian P Mruk

(74) *Attorney, Agent, or Firm* — Oblon, Spivak, McClelland, Maier & Neustadt, L.L.P.

(57) ABSTRACT

Formulations comprising (A) at least one compound selected from aminocarboxylates and polyaminocarboxylates, and salts and derivatives thereof, (B) at least one zinc salt, and (C) at least one homopolymer or copolymer of ethyleneimine.

19 Claims, No Drawings

FORMULATIONS, THEIR USE AS OR FOR PRODUCING DISHWASHING COMPOSITIONS AND THEIR PREPARATION

This application claims benefit of Provisional Ser. No. 61/550,455, filed Oct. 24, 2011.

The present invention relates to formulations comprising (A) at least one compound selected from aminocarboxylates and polyaminocarboxylates, and salts and derivatives thereof, (B) at least one zinc salt, and (C) at least one homopolymer or copolymer of ethyleneimine.

Furthermore, the present invention relates to a process for the preparation of formulations according to the invention and their use as or for producing dishwashing compositions, in particular dishwashing compositions for machine dishwashing.

Dishwashing compositions have to satisfy many requirements. Thus, they have to fundamentally clean the dishes, they should have no harmful or potentially harmful substances in the waste water, they should permit the run-off and drying of the water from the dishes, and they should not lead to problems during operation of the dishwasher. Finally, they should not lead to esthetically undesired consequences on the ware to be cleaned. In this connection, mention is to be made particularly of glass corrosion.

Glass corrosion arises not only as the result of mechanical effects, for example by glasses rubbing together or mechanical contact of the glasses with parts of the dishwasher, but is primarily caused by chemical effects. For example, certain ions can be dissolved out of the glass through repeated machine washing, which changes the optical and thus the esthetic properties in an adverse manner.

In the event of glass corrosion, several effects are observed. Firstly, the formation of microscopically fine cracks can be observed, which become noticeable in the form of lines. Secondly, in many cases, a general hazing can be observed, for example a roughening, which makes the glass in question appear unattractive. Effects of this type are overall also subdivided into iridescent discoloration, formation of ridges, and also sheet-like and ring-like hazing.

It is known from EP 2 118 254 that zinc salts can be used in combination with certain vinyl polymers as inhibitors for preventing glass corrosion.

In EP 0 383 482, it is proposed to use zinc salts with a particle diameter of less than 1.7 mm in order to reduce glass corrosion.

In WO 03/104370, it is proposed to use zinc-containing sheet silicates in order to avoid glass corrosion.

U.S. Pat. No. 5,981,456 and WO 99/05248 discloses numerous dishwashing compositions to which zinc salts or bismuth salts can be added in order to protect cutlery against tarnishing or corrosion.

It is known from WO 2002/64719 that certain copolymers of ethylenically unsaturated carboxylic acids with, for example, esters of ethylenically unsaturated carboxylic acids can be used in dishwashing compositions.

WO 2010/020765 discloses dishwashing compositions which comprise polyethyleneimine. Dishwashing compositions of this type can comprise phosphate or be phosphate-free. They are attributed good inhibition of glass corrosion. Zinc- and bismuth-containing dishwashing compositions are advised against.

However, in many cases, the glass corrosion, in particular the line corrosion and the hazing, is not adequately delayed or prevented.

It was thus the object to provide formulations which are suitable as or for producing dishwashing compositions and which avoid the disadvantages known from the prior art and inhibit glass corrosion or at least reduce it particularly well. It was also the object to provide a process for the preparation of formulations which are suitable as or for producing dishwashing compositions and which avoid the disadvantages known from the prior art. It was also the object to provide uses of formulations.

Accordingly, the formulations defined at the start have been found, also abbreviated to formulations according to the invention.

Formulations according to the invention comprise (A) at least one compound selected from aminocarboxylates and polyaminocarboxylates, within the context of the present invention also abbreviated to aminocarboxylate (A) and polyaminocarboxylate (A) or else compound (A), and also derivatives and preferably salts thereof.

Compound (A) can be present as free acid or preferably in partially or completely neutralized form, i.e. as salt. Suitable counterions are, for example, inorganic cations, for example ammonium, alkali metal or alkaline earth metal, preferably $Mg^{2+}$, particularly preferably $Na^{+}$, $K^{+}$, or organic cations, preferably ammonium substituted with one or more organic radicals, in particular triethanolammonium, N,N-diethanolammonium, N-mono-$C_1$-$C_4$-alkyldiethanolammonium, for example N-methyldiethanolammonium or N-n-butyldiethanolammonium, and N,N-di-$C_1$-$C_4$-alkylethanolammonium.

In one embodiment of the present invention, compound (A) is selected from derivatives of aminocarboxylates and polyaminocarboxylates, for example from methyl or ethyl esters thereof.

Within the context of the present invention, aminocarboxylates (A) are understood as meaning nitrilotriacetic acid and those organic compounds which have a tertiary amino group which has one or two $CH_2$—COOH groups which—as mentioned above—can be partially or completely neutralized. Within the context of the present invention, polyaminocarboxylates (A) are understood as meaning those organic compounds which have at least two tertiary amino groups which, independently of one another, each have one or two $CH_2$—COOH groups which—as mentioned above—can be partially or completely neutralized.

In another embodiment of the present invention, aminocarboxylates (A) are selected from those organic compounds which have a secondary amino group which has one or two CH(COOH) $CH_2$—COOH group(s) which—as mentioned above—can be partially or completely neutralized. In another embodiment of the present invention, polyaminocarboxylates (A) are selected from those organic compounds which have at least two secondary amino groups which each have a CH(COOH)$CH_2$—COOH group which—as mentioned above—can be partially or completely neutralized.

Preferred polyaminocarboxylates (A) are selected from 1,2-diaminoethanetetracetic acid (EDTA), iminodisuccinate (IDS), diethylenetriaminepentaacetate (DTPA), hydroxyethylenediaminetriacetate (HEDTA), and their respective salts, particularly preferably alkali metal salts, in particular the sodium salts.

Preferred aminocarboxylates (A) and polyaminocarboxylates (A) are nitrilotriacetic acid and those organic compounds which have a structure based on an amino acid, the amino group(s) of which has or have one or two $CH_2$—COOH groups and are tertiary amino groups. In this connection, amino acids can be selected from L-amino acids, R-amino acids and enantiomer mixtures of amino acids, for example the racemates.

In one embodiment of the present invention, compound (A) is selected from methylglycinediacetate (MGDA), nitrilotriacetic acid and glutamic acid diacetate, and also derivatives thereof and preferably salts thereof, in particular the sodium salts thereof. Very particular preference is given to methylglycinediacetate and also the trisodium salt of MGDA.

Formulations according to the invention comprise at least one zinc salt (B). Zinc salts (B) can be selected from water-soluble and water-insoluble zinc salts. Within the context of the present invention, in this connection, zinc salts (B) are referred to as water-insoluble if they have a solubility of 0.1 g/l or less in distilled water at 25° C. Zinc salts (B) which have a higher solubility in water are accordingly referred to as water-soluble zinc salts within the context of the present invention.

In one embodiment of the present invention, zinc salt (B) is selected from zinc benzoate, zinc gluconate, zinc lactate, zinc formate, $ZnCl_2$, $ZnSO_4$, zinc acetate, zinc citrate, $Zn(NO_3)_2$, $Zn(CH_3SO_3)_2$ and zinc gallate, preference being given to $ZnCl_2$, $ZnSO_4$, zinc acetate, zinc citrate, $Zn(NO_3)_2$, $Zn(CH_3SO_3)_2$ and zinc gallate.

In another embodiment of the present invention, zinc salt (B) is selected from ZnO, ZnO.aq, $Zn(OH)_2$ and $ZnCO_3$. Preference is given to ZnO.aq.

In one embodiment of the present invention, zinc salt (B) is selected from zinc oxides with an average particle diameter (weight-average) in the range from 10 nm to 100 μm.

The cation in zinc salt (B) can be present in complexed form, for example complexed with ammonia ligands or water ligands, and in particular be present in hydrated form. To simplify the style, within the context of the present invention, ligands are generally omitted if they are water ligands.

Depending on how the pH of mixture according to the invention is adjusted, zinc salt (B) can be converted. Thus, for example, it is possible that, for the preparation of formulation according to the invention, zinc acetate or $ZnCl_2$ is used, although, at a pH of 8 or 9 in an aqueous environment, this is converted to ZnO, $Zn(OH)_2$ or ZnO.aq, which can be present in non-complexed or in complexed form.

Zinc salt (B) is present in those formulations according to the invention which are solid at room temperature preferably in the form of particles, which, for example, have an average diameter (number-average) in the range from 10 nm to 100 μm, preferably 100 nm to 5 μm, determined for example by means of X-ray scattering.

Zinc salt (B) is present in those formulations according to the invention which are liquid at room temperature in dissolved form or in solid form or in colloidal form.

Formulation according to the invention further comprises (C) at least one copolymer or preferably a homopolymer of ethyleneimine, abbreviated together also as polyethyleneimine (C).

Within the context of the present invention, copolymers of ethyleneimine are also to be understood as meaning copolymers of ethyleneimine (aziridine) with one or more higher homologs of ethyleneimine, such as propyleneimine(2-methylaziridine), 1- or 2-butyleneimine(2-ethylaziridine or 2,3-dimethylaziridine), for example with 0.01 to 75 mol % of one or more homologs of ethyleneimine, based on the fraction of ethyleneimine. However, preference is given to those copolymers which comprise only ethyleneimine and in the range from 0.01 to 5 mol % of homologs of ethyleneimine in polymerized-in form, and in particular homopolymers of ethyleneimine.

In one embodiment of the present invention, copolymers of ethyleneimine (C) are selected from graft copolymers of ethyleneimine (C). Graft copolymers of this type are also referred to as ethyleneimine graft copolymers (C) within the context of the present invention. Ethyleneimine graft copolymers (C) can be crosslinked or uncrosslinked.

In one embodiment of the present invention, ethyleneimine graft copolymers (C) are selected from those polymers which are obtainable by grafting polyamidoamines with ethyleneimine. Preferably, ethyleneimine graft copolymers (C) are composed of 10 to 90% by weight of polyamidoamine as graft base and 90 to 10% by weight of ethyleneimine as graft covering, in each case based on ethyleneimine graft copolymer (C).

Polyamidoamines are obtainable, for example, by condensation of polyalkylenepolyamines in pure form, as a mixture with one another or in a mixture with diamines.

Within the context of the present invention, polyalkylenepolyamines are understood as meaning those compounds which comprise at least three basic nitrogen atoms in the molecule, for example diethylenetriamine, dipropylenetriamine, triethylenetetramine, tripropylenetetramine, tetraethylenepentamine, pentaethylenehexamine, N-(2-aminoethyl)-1,3-propanediamine and N,N'-bis(3-aminopropyl) ethylenediamine.

Suitable diamines are, for example, 1,2-diaminoethane, 1,3-diaminopropane, 1,4-diamino-butane, 1,6-diaminohexane, 1,8-diaminooctane, isophoronediamine, 4,4'-diaminodiphenylmethane, 1,4-bis(3-aminopropyl)piperazine, 4,9-dioxadodecane-1,12-diamine, 4,7,10-trioxatridecane-1,13-diamine and α,ω-diamino compounds of polyalkylene oxides.

In another embodiment of the present invention, ethyleneimine graft copolymers (C) are selected from those polymers which can be prepared by grafting polyvinylamines as graft base with ethyleneimine or oligomers of ethyleneimine, for example dimers or trimers of ethyleneimine. Preferably, ethyleneimine graft copolymers (C) are composed of 10 to 90% by weight of polyvinylimine as graft base and 90 to 10% by weight of ethyleneimine as graft covering, in each case based on ethyleneimine graft copolymer (C).

However, as component of formulation according to the invention, preference is given to selecting at least one polyethyleneimine (C) in form of a homopolymer, preferably uncrosslinked.

According to a preferred embodiment of the invention, polyethyleneimine (C) has an average molecular weight $M_n$ of 500 g/mol to 125 000 g/mol, preferably from 750 g/mol to 100 000 g/mol.

In one embodiment of the present invention, polyethyleneimine (C) has an average molecular weight $M_w$ in the range from 500 to 1 000 000 g/mol, preferably in the range from 600 to 75 000 g/mol, particularly preferably in the range from 800 to 25 000 g/mol, determinable for example by gel permeation chromatography (GPC).

In one embodiment of the present invention, polyethyleneimines (C) are selected from highly branched polyethyleneimines. Highly branched polyethyleneimines (C) are characterized by their high degree of branching (DB). The degree of branching can be determined, for example, by $^{13}C$-NMR spectroscopy, preferably in $D_2O$, and is defined as follows:

$$DB=D+T/D+T+L$$

with D (dendritic) corresponding to the fraction of tertiary amino groups, L (linear) corresponding to the fraction of secondary amino groups and T (terminal) corresponding to the fraction of primary amino groups.

Within the context of the present invention, highly branched polyethyleneimines (C) are polyethyleneimines (C) with DB in the range from 0.1 to 0.95, preferably 0.25 to 0.90, particularly preferably in the range from 0.30 to 0.80% and very particularly preferably at least 0.5.

Within the context of the present invention, dendrimeric polyethyleneimines (C) are polyethyleneimines (C) with a structurally and molecularly uniform structure.

In one embodiment of the present invention, the polyethyleneimine (C) is highly branched polyethyleneimines (homopolymers) with an average molecular weight $M_w$ in the range from 600 to 75 000 g/mol, preferably in the range from 800 to 25 000 g/mol.

According to a particular embodiment of the invention, the polyethyleneimine (C) is highly branched polyethyleneimines (homopolymers) with an average molecular weight $M_n$ of 500 g/mol to 125 000 g/mol, preferably from 750 g/mol to 100 000 g/mol, which is selected from dendrimers.

In one embodiment of the present invention, formulations according to the invention comprise in total in the range from 1 to 50% by weight of compound (A), preferably 10 to 25% by weight, in total in the range from 0.05 to 0.4% by weight of zinc salt (B), preferably 0.1 to 0.2% by weight, and in total 0.05 to 2% by weight of homopolymer or copolymer of ethyleneimine (C), preferably 0.1 to 0.5% by weight, optionally in total 0.5 to 15% by weight of bleach (D), based in each case on solids content of the formulation in question.

Here, the fraction of zinc salt is given as zinc and/or zinc ions. Consequently, the fraction of the counterion can be excluded from the calculation.

In one embodiment of the present invention, formulation according to the invention is solid at room temperature, for example a powder or a tablet. In another embodiment of the present invention, formulation according to the invention is liquid at room temperature. In one embodiment of the present invention, formulation according to the invention is granules, a liquid preparation or a gel.

In one embodiment of the present invention, formulation according to the invention comprises 0.1 to 10% by weight of water, based on the sum of all solids of the formulation in question.

Without wishing to give preference to a specific theory, it is possible that in formulations according to the invention zinc salt (B) can be present in a form complexed by polyethyleneimine (C).

In one embodiment of the present invention, formulation according to the invention is free from phosphates and polyphosphates, with hydrogen phosphates being subsumed therewith, for example free from trisodium phosphate, pentasodium tripolyphosphate and hexasodium metaphosphate. "Free from" in connection with phosphates and polyphosphates is to be understood as meaning, within the context of the present invention, that the content of phosphate and polyphosphate in total is in the range from 10 ppm to 0.2% by weight, determined by gravimetry.

In one embodiment of the present invention, formulation according to the invention is free from those heavy metal compounds which do not act as bleach catalysts, in particular from compounds of iron and of bismuth. In connection with heavy metal compounds, "free from" is to be understood as meaning, within the context of the present invention, that the content of heavy metal compounds which do not act as bleach catalysts is in total in the range from 0 to 100 ppm, preferably 1 to 30 ppm, determined in accordance with the Leach method.

Within the context of the present invention, "heavy metals" are all metals with a specific density of at least 6 g/cm$^3$, but not zinc. In particular, heavy metals are precious metals and also bismuth, iron, copper, lead, tin, nickel, cadmium and chromium.

Preferably, formulation according to the invention comprises no measurable fractions of bismuth compounds, i.e. for example less than 1 ppm.

In one embodiment of the present invention, formulation according to the invention comprises one or more bleaches (D), for example one or more oxygen bleaches or one or more chlorine-containing bleaches.

Formulations according to the invention can comprise, for example, 0.5 to 15% by weight of bleach (D).

Examples of suitable oxygen bleaches are sodium perborate, anhydrous or for example as monohydrate or as tetrahydrate or so-called dihydrate, sodium percarbonate, anhydrous or, for example, as monohydrate, hydrogen peroxide, persulfates, organic peracids such as peroxylauric acid, peroxystearic acid, peroxy-α-naphthoic acid, 1,12-diperoxydodecanedioic acid, perbenzoic acid, peroxylauric acid, 1,9-diperoxyazelaic acid, diperoxyisophthalic acid, in each case as free acid or as alkali metal salt, in particular as sodium salt, also sulfonylperoxy acids and cationic peroxy acids.

Formulations according to the invention can comprise, for example, in the range from 0.5 to 15% by weight of oxygen bleaches.

Suitable chlorine-containing bleaches are, for example, 1,3-dichloro-5,5-dimethylhydantoin, N—N-chlorosulfamide, chloramine T, chloramine B, sodium hypochlorite, calcium hypochlorite, magnesium hypochlorite, potassium hypochlorite, potassium dichloroisocyanurate and sodium dichloroisocyanurate.

Formulations according to the invention can comprise, for example, in the range from 3 to 10% by weight of chlorine-containing bleach.

In one embodiment of the present invention, formulation according to the invention can have further ingredients (E), for example one or more surfactants, one or more enzymes, one or more builders, in particular phosphorus-free builders, one or more cobuilders, one or more alkali metal carriers, one or more bleach catalysts, one or more bleach activators, one or more bleach stabilizers, one or more antifoams, one or more corrosion inhibitors, one or more builders, buffers, dyes, one or more fragrances, one or more organic solvents, one or more tableting auxiliaries, one or more disintegrants, one or more thickeners, or one or more solubility promoters.

Examples of surfactants are in particular nonionic surfactants and also mixtures of anionic or zwitterionic surfactants with nonionic surfactants. Preferred nonionic surfactants are alkoxylated alcohols and alkoxylated fatty alcohols, di- and multiblock copolymers of ethylene oxide and propylene oxide and reaction products of sorbitan with ethylene oxide or propylene oxide, alkyl glycosides and so-called amine oxides.

Preferred examples of alkoxylated alcohols and alkoxylated fatty alcohols are, for example, compounds of the general formula (I)

(I)

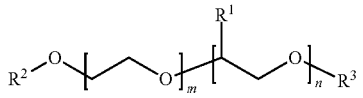

in which the variables are defined as follows:

$R^1$ is identical or different and selected from linear $C_1$-$C_{10}$-alkyl, preferably ethyl and particularly preferably methyl, $R^2$ is selected from $C_8$-$C_{22}$-alkyl, for example n-$C_8H_{17}$, n-$C_{10}H_{21}$, n-$C_{12}H_{25}$, n-$C_{14}H_{29}$, n-$C_{16}H_{33}$ or n-$C_{18}H_{37}$, $R^3$ is selected from $C_1$-$C_{10}$-alkyl, methyl, ethyl, n-propyl, isopropyl, n-butyl, isobutyl, sec.-butyl, tert-butyl, n-pentyl, isopentyl, sec-pentyl, neopentyl, 1,2-dimethylpropyl, isoamyl, n-hexyl, isohexyl, sec-hexyl, n-heptyl, n-octyl, 2-ethylhexyl, n-nonyl, n-decyl or isodecyl, m and n are in the range from zero to 300, where the sum of n and m is at least one. Preferably, m is in the range from 1 to 100 and n is in the range from 0 to 30.

Here, compounds of the general formula (I) may be block copolymers or random copolymers, preferably block copolymers.

Other preferred examples of alkoxylated alcohols and alkoxylated fatty alcohols are, for example, compounds of the general formula (II)

(II)

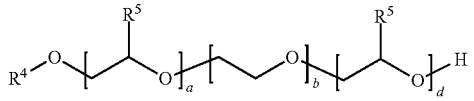

in which the variables are defined as follows:

$R^5$ is identical or different and selected from linear $C_1$-$C_4$-alkyl, preferably in each case identical and ethyl and particularly preferably methyl, $R^4$ is selected from $C_6$-$C_{20}$-alkyl, in particular n-$C_8H_{17}$, n-$C_{10}H_{21}$, n-$C_{12}H_{25}$, n-$C_{14}H_{29}$, n-$C_{16}H_{33}$, n-$C_{18}H_{37}$, a is a number in the range from 1 to 6, b is a number in the range from 4 to 20, d is a number in the range from 4 to 25.

Here, compounds of the general formula (II) can be block copolymers or random copolymers, preferably block copolymers.

Further suitable nonionic surfactants are selected from di- and multiblock copolymers, composed of ethylene oxide and propylene oxide. Further suitable nonionic surfactants are selected from ethoxylated or propoxylated sorbitan esters. Amine oxides or alkyl glycosides are likewise suitable. An overview of suitable further nonionic surfactants can be found in EP-A 0 851 023 and in DE-A 198 19 187.

Mixtures of two or more different nonionic surfactants may also be present.

Examples of anionic surfactants are $C_8$-$C_{20}$-alkyl sulfates, $C_8$-$C_{20}$-alkylsulfonates and $C_8$-$C_{20}$-alkyl ether sulfates with one to 6 ethylene oxide units per molecule.

In one embodiment of the present invention, formulation according to the invention can comprise in the range from 3 to 20% by weight surfactant.

Formulations according to the invention can comprise one or more enzymes. Examples of enzymes are lipases, hydrolases, amylases, proteases, cellulases, esterases, pectinases, lactases and peroxidases.

Formulations according to the invention can comprise, for example, up to 5% by weight of enzyme, preferably 0.1 to 3% by weight, in each case based on the total solids content of the formulation according to the invention.

Formulations according to the invention can comprise one or more builders, in particular phosphate-free builders. Examples of suitable builders are silicates, in particular sodium disilicate and sodium metasilicate, zeolites, sheet silicates, in particular those of the formula $\alpha$-$Na_2Si_2O_5$, $\beta$-$Na_2Si_2O_5$, and $\delta$-$Na_2Si_2O_5$, also citric acid and its alkali metal salts, succinic acid and its alkali metal salts, fatty acid sulfonates, $\alpha$-hydroxypropionic acid, alkali metal malonates, fatty acid sulfonates, alkyl and alkenyl disuccinates, tartaric acid diacetate, tartaric acid monoacetate, oxidized starch, and polymeric builders, for example polycarboxylates and polyaspartic acid.

In one embodiment of the present invention, builders are selected from polycarboxylates, for example alkali metal salts of (meth)acrylic acid homopolymers or (meth)acrylic acid copolymers.

Suitable comonomers are monoethylenically unsaturated dicarboxylic acids such as maleic acid, fumaric acid, maleic anhydride, itaconic acid and citraconic acid. A suitable polymer is in particular polyacrylic acid, which preferably has an average molecular weight $M_w$ in the range from 2000 to 40 000 g/mol, preferably 2000 to 10 000 g/mol, in particular 3000 to 8000 g/mol. Also of suitability are copolymeric polycarboxylates, in particular those of acrylic acid with methacrylic acid and of acrylic acid or methacrylic acid with maleic acid and/or fumaric acid.

It is also possible to use copolymers of at least one monomer from the group consisting of monoethylenically unsaturated $C_3$-$C_{10}$-mono- or dicarboxylic acids or anhydrides thereof, such as maleic acid, maleic anhydride, acrylic acid, methacrylic acid, fumaric acid, itaconic acid and citraconic acid, with at least one hydrophilically or hydrophobically modified monomer, as listed below.

Suitable hydrophobic monomers are, for example, isobutene, diisobutene, butene, pentene, hexene and styrene, olefins having 10 or more carbon atoms or mixtures thereof, such as, for example, 1-decene, 1-dodecene, 1-tetradecene, 1-hexadecene, 1-octadecene, 1-eicosene, 1-docosene, 1-tetracosene and 1-hexacosene, $C_{22}$-$\alpha$-olefin, a mixture of $C_{20}$-$C_{24}$-$\alpha$-olefins and polyisobutene having, on average, 12 to 100 carbon atoms.

Suitable hydrophilic monomers are monomers with sulfonate or phosphonate groups, and also nonionic monomers with hydroxyl function or alkylene oxide groups. By way of example, mention may be made of: allyl alcohol, isoprenol, methoxypolyethylene glycol(meth)acrylate, methoxypolypropylene glycol(meth)acrylate, methoxypolybutylene glycol(meth)acrylate, methoxypoly(propylene oxide-co-ethylene oxide)(meth)acrylate, ethoxypolyethylene glycol (meth)acrylate, ethoxypolypropylene glycol(meth)acrylate, ethoxypolybutylene glycol(meth)acrylate and ethoxypoly (propylene oxide-co-ethylene oxide)(meth)acrylate. The polyalkylene glycols here comprise 3 to 50, in particular 5 to 40 and especially 10 to 30 alkylene oxide units.

Particularly preferred monomers containing sulfonic acid groups here are 1-acrylamido-1-propanesulfonic acid, 2-acrylamido-2-propanesulfonic acid, 2-acrylamido-2-methyl-propanesulfonic acid, 2-methacrylamido-2-methylpropanesulfonic acid, 3-methacrylamido-2-hydroxypropanesulfonic acid, allylsulfonic acid, methallylsulfonic acid, allyloxybenzenesulfonic acid, methallyloxybenzenesulfonic acid, 2-hydroxy-3-(2-propenyloxy)propanesulfonic acid, 2-methyl-2-propene-1-sulfonic acid, styrenesulfonic acid, vinylsulfonic acid, 3-sulfopropyl acrylate, 2-sulfoethyl methacrylate, 3-sulfopropyl methacrylate, sulfomethacrylamide, sulfomethylmethacrylamide, and salts of said acids, such as their sodium, potassium or ammonium salts.

Particularly preferred monomers containing phosphonate groups are vinylphosphonic acid and its salts.

Moreover, amphoteric polymers can also be used as builders.

Formulations according to the invention can comprise, for example, in the range from in total 10 to 50% by weight, preferably up to 20% by weight, of builders.

In one embodiment of the present invention, formulations according to the invention can comprise one or more cobuilders.

Examples of cobuilders are phosphonates, for example hydroxyalkanephosphonates and aminoalkanephosphonates. Among the hydroxyalkanephosphonates, the 1-hydroxyethane-1,1-diphosphonate (HEDP) is of particular importance as cobuilder. It is preferably used as sodium salt, the disodium salt being neutral and the tetrasodium salt being alkaline (pH 9). Suitable aminoalkanephosphonates are preferably ethylenediaminetetramethylenephosphonate (EDTMP), diethylenetriaminepentamethylenphosphonate (DTPMP), and also their higher homologues. They are preferably used in the form of the neutrally reacting sodium salts, e.g. as hexasodium salt of the EDTMP or as hepta- and octa-sodium salts of the DTPMP.

Formulations according to the invention can comprise one or more alkali carriers. Alkali carriers provide, for example, for the pH of at least 9 if an alkaline pH is desired. For example, alkali metal carbonates, alkali metal hydrogen carbonates, alkali metal hydroxides and alkali metal metasilicates are suitable. A preferred alkali metal is in each case potassium, particular preference being given to sodium.

Formulations according to the invention can comprise one or more bleach catalysts. Bleach catalysts can be selected from bleach-boosting transition metal salts and/or transition metal complexes, such as, for example, manganese-, iron-, cobalt-, ruthenium- or molybdenum-salen complexes or manganese-, iron-, cobalt-, ruthenium- or molybdenum-carbonyl complexes. It is also possible to use manganese, iron, cobalt, ruthenium, molybdenum, titanium, vanadium and copper complexes with nitrogen-containing tripod ligands, and also cobalt-, iron-, copper- and ruthenium-amine complexes as bleach catalysts.

Formulations according to the invention can comprise one or more bleach activators, for example N-methylmorpholinium-acetonitrile salts ("MMA salts"), trimethylammoniumacetonitrile salts, N-acylimides such as, for example, N-nonanoylsuccinimide, 1,5-diacetyl-2,2-dioxo-hexahydro-1,3,5-triazine ("DADHT") or nitrile quats (trimethylammonium acetonitrile salts).

Further examples of suitable bleach activators are tetraacetylethylenediamine (TAED) and tetraacetylhexylenediamine.

Formulations according to the invention can comprise one or more corrosion inhibitors. In the present case, this is to be understood as meaning those compounds which inhibit the corrosion of metal. Examples of suitable corrosion inhibitors are triazoles, in particular benzotriazoles, bisbenzotriazoles, aminotriazoles, alkylaminotriazoles, also phenol derivatives such as, for example, hydroquinone, pyrocatechin, hydroxyhydroquinone, gallic acid, phloroglucine or pyrogallol.

In one embodiment of the present invention, formulations according to the invention comprise in total in the range from 0.1 to 1.5% by weight of corrosion inhibitor.

Formulations according to the invention can comprise one or more builders, for example sodium sulfate.

Formulations according to the invention can comprise one or more antifoams, selected for example from silicone oils and paraffin oils.

In one embodiment of the present invention, formulations according to the invention comprise in total in the range from 0.05 to 0.5% by weight of antifoam.

In one embodiment of the present invention, formulations according to the invention can comprise one or more acids, for example methane sulfonic acid.

In one embodiment of the present invention, formulations according to the invention have a pH in the range from 5 to 14, preferably 8 to 13.

The present invention further provides the use of formulations according to the invention for the machine cleaning of crockery and kitchen utensils. Within the context of the present invention, kitchen utensils to be mentioned are, for example, pots, pans, casseroles, also metallic objects such as, for example, skimmers, fish slices and garlic presses.

Preference is given to the use of formulations according to the invention for the machine cleaning of objects which have at least one surface made of glass, which can be decorated or undecorated. In this connection, within the context of the present invention, a surface made of glass is to be understood as meaning that the object in question has at least one section made of glass which comes into contact with the surrounding air and may be soiled upon using the object. Thus, the objects in question may be those which, like drinking glasses or glass bowls, are essentially made of glass. However, they may, for example, also be lids which have individual components made of another material, for example pot lids with edges and handle made of metal.

Surface made of glass may be decorated, for example colored or imprinted, or be undecorated.

The term "glass" includes any desired glasses, for example lead glass and in particular soda-lime glass, crystal glass and borosilicate glasses.

Preferably, the machine cleaning is washing using a dishwasher (automatic dishwashing).

In one embodiment of the present invention, at least one formulation according to the invention is used for the machine cleaning of drinking glasses, glass vases and glass vessels for cooking.

In one embodiment of the present invention, water with a hardness in the range from 1 to 30° German hardness, preferably 2 to 25° German hardness, is used for the cleaning, where German hardness is to be understood in particular as meaning the calcium hardness.

If formulations according to the invention are used for machine cleaning, then, even upon the repeated machine cleaning of objects which have at least one surface made of glass, only a very low tendency towards glass corrosion is observed, and then only if objects which have at least one surface made of glass are cleaned together with heavily soiled cutlery or crockery. Moreover, it is significantly less harmful to use formulation according to the invention for cleaning glass together with objects made of metal, for example together with pots, pans or garlic presses.

The present invention further provides a process for the preparation of formulations according to the invention, also abbreviated to preparation process according to the invention. To carry out the preparation process according to the invention, the procedure may involve, for example, (A) mixing, for example stirring, at least one compound selected from aminocarboxylates and polyaminocarboxylates, and salts and derivatives thereof, (B) at least one zinc salt, (C) at least one homopolymer or copolymer of ethyleneimine and optionally further ingredients (E) in one or more steps with one another in the presence of water, and then removing the water, completely or at least partially.

Compound (A), zinc salt (B) and polyethyleneimine (C) and bleach (D) are defined above.

In one embodiment of the present invention, before the water is at least partially removed, it is possible to mix with one or more further ingredients (E) for formulation according to the invention, for example with one or more surfactants, one or more enzymes, one or more builders, in particular phosphorus-free builders, one or more cobuilders, one or more alkali carriers, one or more bleach catalysts, one or more bleach activators, one or more bleach stabilizers, one or more antifoams, one or more corrosion inhibitors, one or more builders, with buffer or dye.

In one embodiment, the procedure involves removing the water completely or partly, for example to a residual moisture in the range from zero to 5% by weight, from formulation according to the invention by evaporating it, in particular by spray-drying, spray-granulation or compaction.

In one embodiment of the present invention, the water is removed, completely or partially, at a pressure in the range from 0.3 to 2 bar.

In one embodiment of the present invention, the water is removed, completely or partially, at temperatures in the range from 60 to 220° C.

By means of the preparation process according to the invention, formulation according to the invention can be readily obtained.

The cleaning formulations according to the invention can be provided in liquid or solid form, in single-phase or multi-phase, as tablets or in the form of other metering units, in packaged or unpackaged form. The water content of liquid formulations can vary from 35 to 90% water.

The invention is illustrated by working examples.

General: It was ensured that following the first cleaning of the test pieces in the domestic dishwasher until after weighing and visual assessment of the glasses, the test pieces were only handled using clean cotton gloves so that the weight and/or the visual impression of the test pieces was not falsified.

Within the scope of the present invention, % and ppm are always % by weight and ppm by weight, unless expressly stated otherwise, and, in the case of formulations according to the invention, are based on the total solids content.

I. Preparation of Formulations According to the Invention

I.1 Preparation of Base Mixtures

Firstly, base mixtures were prepared which comprised the feed substances according to Table 1. The feed substances were mixed dry.

TABLE 1

Base mixtures for experiments with formulations according to the invention and comparative formulations

| | Base-1 | Base-2 | Base-3 |
|---|---|---|---|
| Protease | 2.5 | 2.5 | 2.5 |
| Amylase | 1 | 1 | 1 |
| n-$C_{18}H_{37}(OCH_2CH_2)_9OH$ | 5 | 5 | 5 |
| Polyacrylic acid $M_w$ 4000 g/mol as sodium salt, completely neutralized | 10 | 10 | 10 |
| Sodium percarbonate (D.1) | 10.5 | 10.5 | 10.5 |
| TAED | 4 | 4 | 4 |
| $Na_2Si_2O_5$ | 2 | 2 | 2 |
| $Na_2CO_3$ | 19.5 | 19.5 | 19.5 |
| Sodium citrate dihydrate | 0 | 22.5 | 30 |
| HEDP | 0.5 | 0.5 | 0.5 |

Note:
All quantitative data in g.
Abbreviations:
MGDA: methylglycinediacetic acid as trisodium salt
TAED: N,N,N',N'-tetraacetylethylenediamine, disodium salt
HEDP: disodium salt of hydroxyethane(1,1-diphosphonic acid)

I.2 Preparation of Formulations According to the Invention

In a 100 ml beaker, 20 ml of distilled water were introduced and the following were added in succession with stirring:

Zinc salt (B.1) or (B.2) according to Table 2 (or 3)

Polyethyleneimine (C.1), (C.2) or (C.3) according to Table 2 (or 3)

The mixture was stirred for 10 minutes at room temperature. MGDA trisodium salt (A.1), dissolved in 30 ml of water, was then added according to Table 2 (or 3). This gave a clearly transparent solution. Then, base mixture according to Table 2 (or 3) was added, the mixture was stirred again, and the water was evaporated.

This gave formulations according to the invention which were tested according to Table 2 (or 3).

To prepare comparison formulations, the procedure was analogous except the zinc salt (B) or the polyethyleneimine (C), or both, was/were omitted.

If, during the dishwasher test with continuous run motor (or during the immersion test), the corresponding fractions of base mixture were metered separately from aqueous solution of (A.1), (B) or (C), the same results were obtained as when the dried formulation with identical amounts of active ingredient was tested. It is thus not a question of the order of the metered addition.

(B.1): $ZnSO_4.7H_2O$. Quantitative data are based on zinc.

(B.2): ZnO. Quantitative data are based on zinc.

(C.1): Polyethylenimine homopolymer, $M_w$ 800 g/mol, DB=0.63

(C.2): Polyethylenimine homopolymer, $M_w$ 5.000 g/mol, DB=0.67

(C.3): Polyethylenimine homopolymer, $M_w$ 25 000 g/mol, DB=0.70

II. Use of Formulations According to the Invention and Comparison Formulations for the Machine Cleaning of Glasses The testing of formulations according to the invention and comparison formulations was carried out as follows.

II.1 Test Method Dishwasher with Continuous Run Motor

Dishwasher: Miele G 1222 SCL

Program: 65° C. (with prewash)

Ware: 3 champagne glasses "GILDS", 3 brandy glasses, "INTERMEZZO"

For the cleaning, the glasses were arranged in the upper crockery basket of the dishwasher. The dishwashing detergent used was in each case 25 g of formulation according to the invention or comparison formulation as in Table 2, where Table 2 specifies the active components (A.1), optionally (B), optionally (C) and base mixture of formulation according to the invention individually in each case. Washing was carried out at a clean-rinse temperature of 55° C. The water hardness was in each case in the range from zero to 2° German hardness. Washing was carried out in each case for 100 wash cycles, i.e. the program was left to run 100×. The evaluation was carried out gravimetrically and visually after 100 wash cycles. The weight of the glasses was determined before the start of the first wash cycle and after drying after the last wash cycle. The weight loss is the difference in the two values.

As well as the gravimetric evaluation, a visual assessment of the ware after 100 cycles in a darkened chamber under light behind an aperture diaphragm was awarded using a grading scale from 1 (very poor) to 5 (very good). Here, in each case grades were determined for sheet-like corrosion/hazing and line corrosion.

II.2 Test Method Immersion Test

Equipment:

Stainless steel pot (volume ca. 6 liters) with lid with hole for contact thermometer Mesh base insert with mounting for the stainless steel pot Magnetic stirrer with stirrer rod, contact thermometer, rubber stopper with hole Experimental Conditions:

Temperature: 75° C.

Time: 72 hours 5 liters of distilled water or water with defined water hardness ("hardness water")

The test pieces used were in each case a champagne glass and a brandy glass from Libbey (NL), material: soda-lime glasses.

Experimental Procedure:

For the purposes of the pretreatment, the test pieces were firstly washed in a domestic dishwasher (Bosch SGS5602) with 1 g of surfactant (n-$C_{18}H_{37}(OCH_2CH_2)_{10}OH$) and 20 g of citric acid in order to remove any contaminations. The test pieces were dried, their weight was determined, and they were fixed to the mesh base insert.

The stainless steel pot was filled with 5.5 liters of water, and 25 g of the formulation according to the invention or comparative formulation were added, where Table 3 specifies the active components (A.1), optionally (B), optionally (C) and base mixture of formulation according to the invention or comparison formulation individually in each case. The cleaning liquor obtained in this way was stirred using the magnetic stirrer at 550 revolutions per minute. The contact thermometer was installed and the stainless steel pot was covered with the lid so that no water could evaporate during the experiment. It was heated to 75° C. and the mesh base insert with the two test pieces was placed into the stainless steel pot, it being ensured that the test pieces were completely immersed into the liquid.

At the end of the experiment, the test pieces were taken out and rinsed under running distilled water. The test pieces were then washed in the domestic dishwasher using a formulation consisting of 1 g of surfactant (n-$C_{18}H_{37}(OCH_2CH_2)_{10}OH$) and 20 g of citric acid, again using the 55° C. program, in order to remove any deposits.

In order to assess the gravimetric abrasion, the dry test pieces were weighed. The visual assessment of the test pieces was then carried out. For this, the surface of the test pieces was assessed with regard to line corrosion (glass ridges) and hazing corrosion (sheet-like hazing).

The evaluations were made in accordance with the following scheme.

Line Corrosion:

L5: no lines visible

L4: slight line formation in very few areas, fine line corrosion

L3: line corrosion in a few areas

L2: line corrosion in several areas

L1: severe line corrosion

Glass Hazing

L5: no hazing visible

L4: slight hazing in very few areas

L3: hazing in a few areas

L2: hazing in several areas

L1: severe hazing over virtually the whole glass surface

During the assessment, intermediate grades (e.g. L3-4) were also allowed.

If, instead of water, hardness water with 2° German hardness was used for the tests, then formulations according to the invention were likewise always superior to the corresponding comparison formulations in terms of the inhibition of the glass corrosion.

II.3 Results

The results are summarized in Tables 2 and 3.

TABLE 2

Results of the tests with dishwasher

| Example | Base mixture: [g] | (A.1) [g] | (B) [mg] | (C) [mg] | Weight loss champagne glass [mg] | Weight loss brandy glass [mg] | Visual evaluation champagne glass | Visual evaluation brandy glass |
|---|---|---|---|---|---|---|---|---|
| C-1 | Base-1: 13.75 | 11.25 | — | — | 60.1 | 26 | L1, T1 | L1, T2 |
| C-2 | Base-2: 19.37 | 5.63 | — | — | 42.8 | 23 | L1-2, T2 | L2, T2 |
| C-3 | Base-3: 21.25 | 3.75 | — | — | 36.7 | 19 | L2, T2-3 | L2, T2 |
| C-4 | Base-3: 21.25 | 3.75 | 240 (B.1) | — | 11 | 6 | L4, T4 | L4, T4-5 |
| C-5 | Base-3: 21.25 | 3.75 | 120 (B.1) | — | 16 | 7 | L4, T4-5 | L4, T4 |
| C-6 | Base-3: 21.25 | 3.75 | 40 (B.1) | — | 24 | 11 | L3, T2-3 | L3, T2 |
| 7 | Base-3: 21.25 | 3.75 | 80 (B.1) | 130 (C.1) | 4.8 | 2.6 | L5, T5 | L5, T5 |
| 8 | Base-3: 21.25 | 3.75 | 80 (B.1) | 130 (C.2) | 5.7 | 2.7 | L5, T5 | L5, T5 |
| 9 | Base-3: 21.25 | 3.75 | 80 (B.1) | 130 (C.3) | 7.2 | 3.1 | L5, T4-5 | L4-5, T4-5 |
| 10 | Base-3: 21.25 | 3.75 | 80 (B.1) | 65 (C.1) | 6.9 | 3.2 | L5, T5 | L4-5, T5 |
| 11 | Base-3: 21.25 | 3.75 | 80 (B.1) | 65 (C.2) | 7.4 | 3.9 | L5, T4-5 | L4-5, T4-5 |
| 12 | Base-3: 21.25 | 3.75 | 80 (B.1) | 65 (C.3) | 8.6 | 4.2 | L4-5, T4-5 | L4-5, T4-5 |
| 13 | Base-3: 21.25 | 3.75 | 40 (B.1) | 65 (C.1) | 5.2 | 2.6 | L4-5, T5 | L5, T5 |
| 14 | Base-3: 21.25 | 3.75 | 40 (B.1) | 65 (C.2) | 6 | 2.7 | L4-5, T5 | L4-5, T5 |
| 15 | Base-3: 21.25 | 3.75 | 40 (B.1) | 65 (C.3) | 7.3 | 3.6 | L4-5, T4-5 | L4-5, T5 |
| 16 | Base-3: 21.25 | 3.75 | 40 (B.1) | 32 (C.1) | 7.1 | 4.4 | L5, T4 | L5, T4-5 |
| 17 | Base-3: 21.25 | 3.75 | 40 (B.1) | 32 (C.2) | 7.4 | 4.7 | L4-5, T4-5 | L4,5, T4 |
| 18 | Base-3: 21.25 | 3.75 | 20 (B.1) | 32 (C.1) | 6 | 3.4 | L5, T4-5 | L5, T5 |
| 19 | Base-3: 21.25 | 3.75 | 20 (B.1) | 32 (C.2) | 6.8 | 3.9 | L5, T4-5 | L5, T5 |
| 20 | Base-3: 21.25 | 3.75 | 20 (B.1) | 16 (C.1) | 6.8 | 4.1 | L4-5, T4-5 | L4-5, T4-5 |
| 21 | Base-3: 21.25 | 3.75 | 20 (B.1) | 16 (C.2) | 7.8 | 4.8 | L4, T4-5 | L4, T4-5 |
| 22 | Base-2: 19.37 | 5.63 | 40 (B.1) | 32 (C.1) | 9.4 | 6.8 | L4, T4 | L4-5, T4 |
| 23 | Base-3: 21.25 | 3.75 | 80 (B.2) | 32 (C.1) | 6.9 | 4.2 | L4, T4-5 | L4, T4 |
| 24 | Base-3: 21.25 | 3.75 | 40 (B.2) | 32 (C.1) | 7.3 | 4.3 | L4, T4 | L4, T4 |
| 25 | Base-3: 21.25 | 3.75 | 20 (B.2) | 32 (C.1) | 7.8 | 4.9 | L4, T4 | L4, T4 |

TABLE 3

| Immersion tests | | | | | | | | |
|---|---|---|---|---|---|---|---|---|
| Example | Base mixture: [g] | (A.1) [g] | (B) [mg] | (C) [mg] | Weight loss champagne glass [mg] | Weight loss brandy glass [mg] | Visual evaluation champagne glass | Visual evaluation brandy glass |
| V-I.1 | Base-3: 21.25 | 3.75 | — | — | 169.20 | 95.10 | L2, T2 | L2, T3 |
| V-I.2 | Base-3: 21.25 | 3.75 | 40 | — | 118.60 | 63.70 | L3, T2-3 | L3, T3 |
| V-I.3 | Base-3: 21.25 | 3.75 | 240 | — | 74.60 | 41.00 | L3-4, T3-4 | L4, T3-4 |
| I.4 | Base-3: 21.25 | 3.75 | 30 | 48 (C.1) | 49.40 | 26.30 | L3-4, T4-5 | L4-5, T4-5 |
| I.5 | Base-3: 21.25 | 3.75 | 30 | 48 (C.2) | 76.70 | 40.40 | L3-4, T4 | L3-4, T3-4 |
| I.6 | Base-3: 21.25 | 3.75 | 40 | 65 (C.1) | 42.50 | 23.60 | L4, T4-5 | L4-5, T4-5 |
| I.7 | Base-3: 21.25 | 3.75 | 40 | 65 (C.2) | 61.90 | 32.00 | L3-4, T4 | L3-4, T3-4 |
| I.8 | Base-3: 21.25 | 3.75 | 80 | 130 (C.1) | 41.90 | 22.00 | L4, T4-5 | L4-5, T4-5 |
| I.9 | Base-3: 21.25 | 3.75 | 80 | 130 (C.2) | 58.90 | 30.60 | L3-4, T4 | L3-4, T3-4 |
| I.10 | Base-3: 21.25 | 3.75 | 240 | 390 (C.1) | 28.40 | 15.30 | L4-5, T5 | L4-5, T5 |
| I.11 | Base-3: 21.25 | 3.75 | 240 | 390 (C.2) | 34.50 | 18.20 | L4-5, T4-5 | L4, T4-5 |

The invention claimed is:

1. A formulation, comprising:

(A) in total, from 1 to 50% by weight of at least one compound selected from the group consisting of methylglycine diacetate (MGDA) and the trisodium salt of MGDA, (B) in total, from 0.05 to 0.4% by weight of at least one zinc salt, given as Zn, (C) in total, 0.05 to 2% by weight of at least one homopolymer of ethyleneimine or copolymer of ethyleneimine, and (D) optionally, 0.5 to 15% by weight of bleach, based in each case on the solids content of said formulation.

2. The formulation according to claim 1, which is free from a phosphate and a polyphosphate.

3. The formulation according to claim 1, wherein (C) is selected from the group consisting of homopolymers of ethyleneimine, linear copolymers of ethyleneimine, branched copolymers of ethyleneimine, and graft copolymers of ethyleneimine.

4. The formulation according to claim 1, wherein zinc salt is selected from the group consisting of $ZnCl_2$, $ZnSO_4$, zinc acetate, zinc citrate, $Zn(NO_3)_2$, $Zn(CH_3SO_3)_2$ and zinc gallate.

5. The formulation according to claim 1, which is solid at room temperature.

6. The formulation according to claim 1, which comprises from 0.1 to 10% by weight of water.

7. The formulation according to claim 1, which comprises (D) at least one bleach selected from the group consisting of oxygen bleaches and chlorine-containing bleaches.

8. The formulation according to claim 1, which comprises component (D).

9. A method for the machine cleaning of crockery, kitchen utensils or both, comprising:

contacting said crockery, kitchen utensils or both with a formulation according to claim 1.

10. A method for the machine cleaning of an object, comprising:

contacting said object with a formulation according to claim 1, wherein said object has at least one surface comprising glass, which is optionally decorated.

11. The method according to claim 9, wherein the machine cleaning is washing or cleaning using a dishwasher.

12. The method according to claim 10, wherein said object is selected from the group consisting of drinking glasses, glass vases and glass vessels for cooking.

13. The method according to claim 10, wherein said surface is decorated.

14. The method according to claim 10, wherein the machine cleaning is washing or cleaning using a dishwasher.

15. The formulation according to claim 1, wherein component C) is a homopolymer.

16. The formulation according to claim 1, wherein component C) is a copolymer.

17. A process for the preparation of a formulation, comprising:

mixing, in one or more steps, the following components with one another in the presence of water (A) in total, from 1 to 50% by weight of at least one compound selected from the group consisting of methylglycine diacetate (MGDA) and the trisodium salt of MGDA, (B) in total, from 0.05 to 0.4% by weight of at least one zinc salt, given as Zn, (C) in total, 0.05 to 2% by weight of at least one homopolymer of ethyleneimine or copolymer of ethyleneimine, (D) optionally, 0.5 to 15% by weight of bleach, based in each case on the solids content of said formulation, and optionally, further ingredients, and then removing the water.

18. The process according to claim 17, wherein said bleach is present and is selected from the group consisting of oxygen bleaches and chlorine-containing bleaches.

19. The process according to claim 17, wherein the water is removed by spray-drying, spray-granulation or compaction.

* * * * *